United States Patent [19]

Fischer

[11] 4,350,094

[45] * Sep. 21, 1982

[54] INK TRANSFER APPARATUS FOR ROTARY OFFSET PRINTING MACHINES

[75] Inventor: Hermann Fischer, Augsburg, Fed. Rep. of Germany

[73] Assignee: M.A.N.-ROLAND Druckmaschinen Aktiengesellschaft, Offenbach am Main, Fed. Rep. of Germany

[ * ] Notice: The portion of the term of this patent subsequent to Mar. 16, 1999, has been disclaimed.

[21] Appl. No.: 186,531

[22] Filed: Sep. 12, 1980

[30] Foreign Application Priority Data

Oct. 23, 1979 [DE] Fed. Rep. of Germany ..... 2942689

[51] Int. Cl.[3] ..... B41F 31/14; B41F 31/26

[52] U.S. Cl. ..... 101/350

[58] Field of Search ..... 101/147, 148, 349–352, 101/363, 364, 340, 341, 344, 345, 347, 355, 356, 357, 360, 361, 204, 205, 206, 207, 208–210, 342, 343, 346, 348, 353, 354, 358, 359; 118/262, 258

[56] References Cited

U.S. PATENT DOCUMENTS

| | | | |
|---|---|---|---|
| 2,436,455 | 2/1948 | Seybold | 101/350 |
| 2,821,133 | 1/1958 | Brodie | 101/350 X |
| 3,106,154 | 10/1963 | Saul | 101/350 X |
| 3,150,589 | 9/1964 | Senogles | 101/350 |
| 3,261,287 | 7/1966 | Brodie | 101/148 |
| 4,129,077 | 12/1978 | Fischer | 101/350 |

FOREIGN PATENT DOCUMENTS 2916291 4/1979 Fed. Rep. of Germany .

*Primary Examiner*—J. Reed Fisher

*Attorney, Agent, or Firm*—Frishauf, Holtz, Goodman & Woodward

[57] ABSTRACT

To replace a plurality of ink transfer rollers which may include axially oscillating rollers in a printing system, while still providing for uniformity of application of ink from a film ink system (10, 11) to the plate cylinder (2) of a printing machine, a cage (7) is provided with two rollers (8, 9) projecting therefrom, one roller (9) being in surface contact and ink transfer relation to the ink pick-up roller (10) and the other (8) being in surface contact and ink transfer relation to an ink application roller (6), preferably axially oscillating, which is contact with further application rollers (4, 5) which apply the ink to the plate cylinder. The cage (7) additionally retains a plurality of roller elements, preferably cylinders, which can be guided within the cage by inclined guide tracks (17) for floating, but mutually engaged alignment within the cage, to thereby work ink between the roller elements (12) and the first and second rollers projecting from the cage between which ink is being transferred.

10 Claims, 2 Drawing Figures

INK TRANSFER APPARATUS FOR ROTARY OFFSET PRINTING MACHINES

CROSS REFERENCE TO RELATED APPLICATIONS

Figure 1:
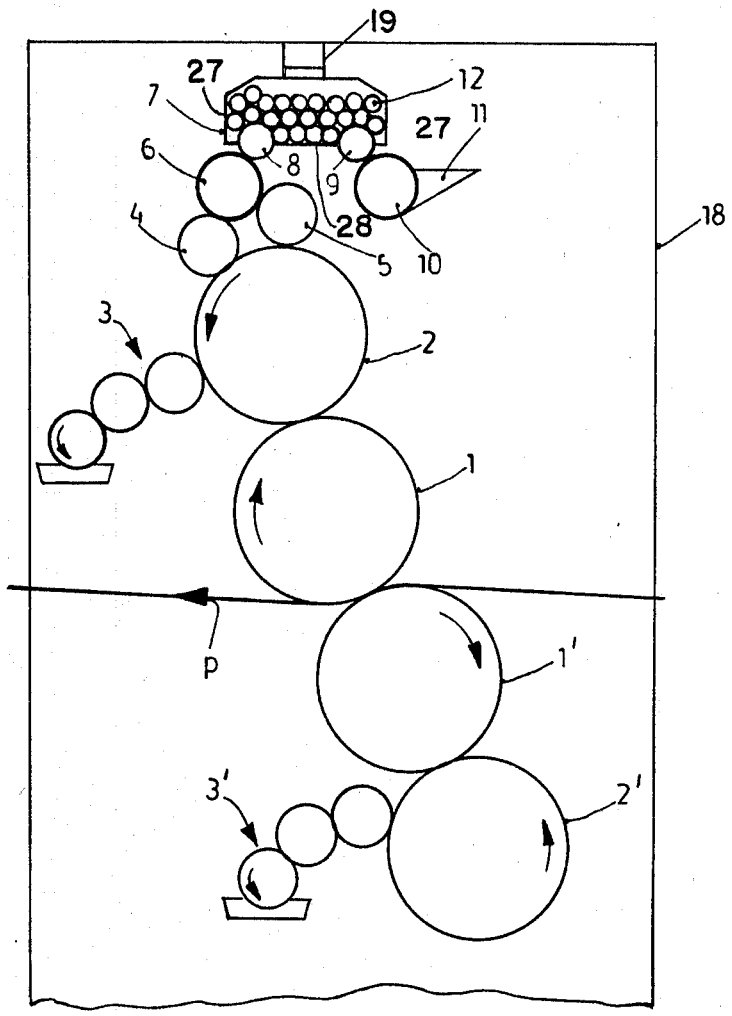

U.S. Ser. No. 186,423, filed Sept. 12, 1980, by the inventor hereof;

U.S. Ser. No. 186,438, filed Sept. 12, 1980, by the inventor hereof;

U.S. Ser. No. 186,532, filed Sept. 12, 1980, by the inventor hereof;

U.S. Ser. No. 186,533, filed Sept. 12, 1980, by the inventor hereof;

U.S. Ser. No. 186,439, filed Sept. 12, 1980, by the inventor hereof.

The present invention relates to an ink transfer apparatus for rotary offset printing machines, and more particularly to an apparatus which is simple and can be readily associated with existing machines to improve the quality of the printing obtained.

BACKGROUND AND PRIOR ART

The quality of offset printing depends substantially on the uniformity of application of ink and wetting liquid. Many efforts have been made to obtain as good a result as possible while using a simple construction. To transfer ink from an ink supply trough on the plate cylinder which is to be inked, it has been customary to provide a number of transfer rollers, ink grinding cylinders, for example rollers which are axially oscillating, and to utilize several ink application rollers. The effort which has been made was directed to the aim to provide a film of ink which has the required uniformity and thickness. It is desirable to simplify offset printing machines and to reduce the space requirements of the inking system and all the rollers in the ink train. Difficulties arise due to the mutually contradictory requirements—for uniformity a large number of rollers, and for simplicity as low a number of rollers—which has been discussed in the literature, for example, see German Patent Disclosure Document DE-OS 29 16 291.

THE INVENTION

It is an object to provide an ink transfer apparatus to be used in combination with rotary offset printing machines which is comparatively inexpensive to manufacture, small in size, while still providing optimum efficiency in supplying ink as an ink film of uniform thickness and uniform consistency to the printing machine.

Briefly, in accordance with the invention, ink is received from an ink pick-up roller, for example directly coupled to an ink ductor roller or to an ink film supply apparatus—for example using a doctor blade—from which ink pick-up roller the ink is transferred to an ink application roller applying the ink to the plate cylinder of the printing machine. In accordance with the invention, the transfer apparatus which transfers the ink from the pick-up roller to the application roller is a cage-like structure which retains a plurality of rotating elements having circular diameter, for example balls or rollers extending essentially transversely of the ink rollers of the inking train. Two of the rollers are in engagement, respectively, with the ink pick-up cylinder and the ink transfer cylinder applying the ink to the plate of the machine. The remaining rollers, which may be floating, operating centerlessly within the machine or guided with movable floating stub shafts in guideways are in rolling engagement with the end rollers retained in the cage, to provide a plurality of rollers within the cage to homogenize the ink therein, being rotated by mutual frictional engagement.

The structure has the advantage that ink transport and transfer is efficiently and easily effected, so that the system can be used in rotary offset printing machines in which the requirements for printing quality are not extremely high, yet, which provide good printing results. A typical application, for example, is an offset printing machine providing forms, newspapers, or for use with electronic data processing apparatus. The ink transfer system can be used instead of a large number of ink transfer rollers within an ink tray which may previously have been deemed necessary, and may also replace one or more axially oscillating roller. Thus, the system permits replacement of a single roller, for example an axially oscillating roller, which requires substantially more operating energy than the present system.

The large number of contact points or contact lines between the respective roller elements retained in the cage has a homogenizing and equalizing effect on the ink as such. The roller elements, within the cage, do not require separate drive arrangements, and no predetermined fixed bearings, so that manufacture is simplified and in operation the system is effectively maintenance-free. If required, and when combined for example with an already constructed printing system, the quality of output printing is improved. It is thus possible to upgrade existing printing apparatus if higher quality of output print is required from the printing machine, without introducing additional bearings and roller structures for the inking system. The cage arrangement with the rollers therein may, of course, also be used in newly designed or in existing printing systems as a separate component.

DRAWINGS

Figure 2:
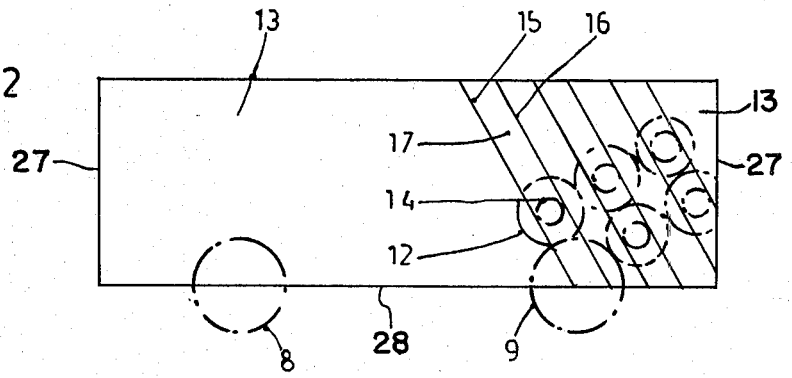

FIG. 1 is a highly schematic side view of a double-sided printing rotary offset printing machine, in which only the upper printing system includes the inking system in accordance with the present invention; and FIG. 2 is a highly schematic side view, partly in phantom representation, of the cage retaining the rollers, including their centering structure.

A printing machine having a dual printing system—see FIG. 1—has, as is customary, two rubber or blanket cylinders 1, 1' through which a paper web p is transported in the direction of the arrow. Two plate cylinders 2, 2' cooperate with the blanket cylinders 1, 1'. The lower system is constructed identically to the system above the paper web p and is not further described in detail.

The upper printing system has a wetting fountain 3 associated therewith to provide wetting liquid, typically water, and receives ink from ink application rollers 4, 5.

The application rollers 4, 5 receive ink from a milling roller 6, which applies an ink film thereto. The roller 6 is driven at about the same circumferential speed as plate cylinder 2. The ink is supplied from an ink trough 11 which applies ink to an ink supply roller 10 in a measured amount, for example by use of a doctor blade.

In accordance with the present invention, ink is transferred from the ink pick-up roller 10 to the milling roller 6 by a plurality of rollers retained within a cage-like holder 7. The cage-like holder 7 has two roller elements with circular diameter, preferably rollers or cylinders 8, 9 extending therefrom which are in engagement with the respective rollers 6, 10. The cage 7, with its contents, is seated on the rollers 6, 10 by its own weight. A large number of roller elements 12 is retained within the cage 7 to transfer ink from roller 9 to roller 8, and hence transfer ink from the ink trough 11 via pick-up roller 10 to the milling roller 6 and hence to the application rollers 4, 5. The roller elements 12 are located adjacent each other and above each other; they are driven by friction due to their mutual surface engagement. Preferably, the number of roller elements 12 in any one plane, and particularly between the rollers 8, 9, is even in order to reduce internal friction. The adjacent position of the respective roller elements 12 permits simple, centerless drive of the roller elements by rotation imparted to rollers 8, 9 by their engagement, respectively, with the driven rollers 6, 10.

In operation of the printing machine, ink is transported from trough 11 over the ink pick-up roller 10 to the roller element 9 within the cage 7. After the rollers within the cage 7 are suitably inked, that is, upon saturation of ink within the roller 7, the ink is transferred over roller 8 to the milling roller 6. The ink film on milling roller 6 is further split and transferred to the application rollers 4, 5 and hence to the plate cylinder 2.

In some arrangements it is possible to apply roller 8 directly on one of the application rollers 4, 5 and eliminate the milling roller 6 which may be oscillating axially, particularly if the requirements on the uniformity of application of ink are not particularly critical.

The large number of contact positions, essentially contact points or lines, of the respective roller elements within the cage 7, results in homogenization of the ink to be transferred and uniformity of application of ink throughout the axial length of the cage 12 which, like rollers 8, 9, preferably matches the longest axial extent of rollers 6, 10 and any axial excursions thereof. Sufficient rollers are placed in the cage to form several layers of rollers—see FIG. 1. The ink throughput through the cage 7 and the rollers contained therein is optimal, so that water-ink emulsion is reduced due to the substantially large surface area of all the roller elements 12 within the cage 7. Heating of ink also is substantially reduced. Striping and formation of excessive localized ink deposits is reduced to a minimum, since the presence of the plurality of rollers or balls, respectively, within the cage forms a reservoir for contaminants. The system additionally has the advantage that it is completely independent of direction of rotation of the cylinder of the printing machine. No reversal switching is necessary; this is particularly desirable in inking systems of rotary offset printing machines used in newspaper printing or the like, since the machine can then be substantially simplified.

The assembly of rollers in the ink train is substantially cheaper than customary multiple-roller or cylinder ink trains and, due to the independence of the system from the direction of rotation, it can be used in all applications where differences in speed between rotating rollers or cylinders arise. For example, the ink pick-up roller 10 can operate at a speed which is slow with respect to that of the milling roller 6.

The roller elements 12 within the cage 7 may be in the form of balls, cylinders, or other rolling elements. If cylinders or roller elements, they can be placed centerless, that is, to rotate without bearings. In some applications, it is desirable to stabilize the position of rollers within the holder 7 to some extent at least. As seen in FIG. 2, the side walls 13 of the cage-like container 7 have parallel inclined guide ribs 15, 16 applied thereto, forming guide grooves or guide tracks 17 therebetween. The roller elements 12 have axially extended guide pins or stubs 14 which fit into the grooves or tracks 17 so that their relative adjacent position is predetermined and stabilized, while permitting movement of the rollers with respect to each other. The fragmentary illustration of FIG. 2 clearly shows the arrangement.

The cage 7 can be easily applied between side walls 18 of the machine to be seated on the rollers 6, 10, respectively. The required pressure of application between the rollers 8, 9 and the rollers 6, 10, respectively, is obtained by the inherent weight of the holder 7 and its contents. Additional stabilization of the position may be obtained by forming a guide track 19 or a releasable attachment holder on the side walls 18 of the machine to guide the position of the cage 7 and its contents. The cage 7 may be formed with ventilating openings to permit through-flow of air or other drying fluid.

Various changes and modifications may be made, and the ink transport apparatus can be used with different types of printing machines in various applications; for example, the system can be used as a direct replacement of a single roller or a roller train of an existing machine; due to the absence of the defined bearings, the replacement element is substantially cheaper than the rollers which it replaces. Likewise, the independence of the respective elements 12 within the cage permit large differences of speed between the roller 10 in engagement with roller 9, projecting from the cage 7, and the roller 6 in engagement with roller 7 projecting from the cage at the other end thereof. Preferably, rollers 8, 9 are secured in position within the cage to project from the bottom wall 18 of the cage as seen, for example, in FIG. 2. The diameters of the projecting rollers 8, 9 preferably are greater than those of the roller elements 12. The cage 7 has confining end walls 27 and a bottom wall 28.

The system is particularly suitable when applied to a film inking system, in which ink is applied to the ink pick-up roller 10 and its thickness controlled by a doctor blade.

I claim:

1. Ink transfer apparatus for a rotary offset printing machine having a plate cylinder (2) to apply ink to the plate cylinder of the machine, said ink transfer apparatus consisting of means (11) for furnishing printing ink;

an ink pick-up roller (10) receiving ink from the ink furnishing means;

at least one ink application roller (4, 5, 6) applying ink to the plate cylinder of the printing machine and being driven at about the same circumferential speed as the plate cylinder, said at least one ink application roller being spaced from and out of driving contact with said ink pick-up roller (10);

and an ink roller train bridging the gap between said ink pick-up roller (10) and said at least one ink application roller, said ink roller train comprising, in accordance with the invention, a cage-like holder (7) positioned to bridge the gap between the ink pick-up roller (10) and the at least one ink application roller (4, 5, 6), said cage-like holder having confining end walls (27) and a bottom wall (28);

two ink transferring rollers (8, 9) having an ink accepting surface projecting from the cage-like holder and positioned respectively, in surface engagement and in frictional rotation transfer relation with the ink pick-up roller (10) and the at least one ink application roller (4, 5, 6) for receiving ink from the ink pick-up roller, and providing ink to the at least one ink application roller, the ink transferring rollers projecting through the bottom wall (28) for driving surface contact, respectively, with the ink pick-up roller and the at least one ink application roller;

and a plurality of loose roller elements (12) freely, centerless floatingly located in the cage-like holder (7) for centerless, self-positioned rolling movement between the confining walls and the bottom wall of the cage, some of the roller elements being in surface engagement with said ink transferring rollers (8,9) and some of the roller elements (12) being in surface engagement with each other to increase the surface area of ink being transported within the ink train, the plurality of roller elements (12) being of such number that the distance within the cage-like holder (7) between the ink transferring rollers (8, 9) is spanned by at least some of the roller elements (12) and which will assume positions between the ink transferring rollers, the plurality of roller elements being rotated by surface frictional engagement with the ink transferring rollers (8, 9).

2. Ink transfer apparatus according to claim 1, wherein said at least one roller comprises an axially oscillating roller (6), in rolling engagement with one roller (8) of the ink transferring rollers (8, 9) of said ink roller train.

3. Ink transfer apparatus according to claim 1, wherein the ink pick-up roller (10) is a driven roller having a circumferential speed which is low with respect to the circumferential speed at which said at least one ink application roller (6) is driven.

4. Ink transfer apparatus according to claim 1, wherein the machine comprises a frame (18) and guide means (19) on said frame guiding the position of the cage (7) in the frame to stabilize the position of the cage, and the rollers (8, 9) and rolling elements (12) therein with respect to the ink pick-up roller (10) and said at least one application roller (4, 5, 6).

5. Ink transfer apparatus according to claim 1, wherein the roller elements (12) and said ink transferring rollers (9, 8) are positioned adjacent each other in two dimensions, and have ink-accepting surfaces.

6. Ink transfer apparatus according to claim 1, wherein the roller elements (12) comprise elongated cylindrical elements;

the inner walls of the cage (7) are formed with guide tracks (17), the cylindrical elements being formed with projecting guide stubs engaging said guide tracks to position said cylindrical roller elements loosely within the cage (7).

7. Ink transfer apparatus according to claim 1, wherein said ink transferring rollers (9, 8) have a diameter which is large with respect to the diameters of the roller elements (12) within said cage.

8. Ink transfer apparatus according to claim 1, wherein an even number of roller elements (12) is positioned between said ink transferring rollers (9, 8) within the cage in any one plane essentially parallel to a plane connecting the axes of said ink transferring rollers.

9. Ink transfer apparatus according to claim 1, wherein the ink furnishing means (11) and the ink pick-up roller (10) comprise a film inking system.

10. Ink transfer apparatus according to claim 1, wherein said plurality of roller elements (12) is of such number that several layers of roller elements are retained within the cage-like holder (7).

* * * * *